US010177512B2

(12) United States Patent
Zhao

(10) Patent No.: US 10,177,512 B2
(45) Date of Patent: Jan. 8, 2019

(54) SIMPLIFIED ELECTRICAL CONNECTOR

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/854,003

(22) Filed: Dec. 26, 2017

(65) Prior Publication Data

US 2018/0183193 A1 Jun. 28, 2018

(30) Foreign Application Priority Data

Dec. 27, 2016 (CN) ..... 2016 2 1444186 U

(51) Int. Cl.

| | |
|---|---|
| ***H01R 13/648*** | (2006.01) |
| ***H01R 24/64*** | (2011.01) |
| ***H01R 13/646*** | (2011.01) |
| ***H01R 13/6471*** | (2011.01) |
| ***H01R 13/6586*** | (2011.01) |
| ***H01R 24/60*** | (2011.01) |
| *H01R 12/57* | (2011.01) |

(52) U.S. Cl.

CPC ..... *H01R 24/64* (2013.01); *H01R 13/646* (2013.01); *H01R 13/6471* (2013.01); *H01R 13/6586* (2013.01); *H01R 24/60* (2013.01); *H01R 12/57* (2013.01)

(58) Field of Classification Search

CPC .. H01R 24/64; H01R 13/646; H01R 13/6471; H01R 13/6586; H01R 24/60; H01R 12/57

USPC ..... 439/607.35, 607.36, 607.05

See application file for complete search history.

(56) References Cited

U.S. PATENT DOCUMENTS

| | | | | |
|---|---|---|---|---|
| 2018/0138642 | A1* | 5/2018 | Kong | H01R 13/6594 |
| 2018/0159277 | A1* | 6/2018 | Yu | H01R 13/73 |
| 2018/0175560 | A1* | 6/2018 | Zhang | H01R 12/716 |
| 2018/0191092 | A1* | 7/2018 | Zhou | H01R 12/716 |
| 2018/0205183 | A1* | 7/2018 | Zhao | H01R 13/6585 |

FOREIGN PATENT DOCUMENTS

CN 205452597 U 8/2016

* cited by examiner

*Primary Examiner* — Khiem Nguyen

(74) *Attorney, Agent, or Firm* — Wei Te Chung; Ming Chieh Chang

(57) ABSTRACT

A horizontal type electrical connector includes a terminal module having an insulative housing with a base and a mating tongue extending forwardly from the base wherein the mating tongue forms opposite first and second mating surfaces. The plurality of contacts are integrally formed within the housing, and including a plurality of first contacts having corresponding contacting sections exposed upon the first surface in a full manner while only a pair of second contacts having corresponding contacting sections exposed upon the second surface at a center region. The second mating surface forms a plurality of protrusions aligned with the corresponding contacting sections of the first contacts in the vertical direction so as to performing dummy contacting sections for providing a balanced force arrangement for the inserted complementary plug connector.

12 Claims, 5 Drawing Sheets

SIMPLIFIED ELECTRICAL CONNECTOR

1. FIELD OF THE DISCLOSURE

The invention is related to an electrical connector assembly, and particularly to the USB Type C connector with a simplified contact arrangement.

2. DESCRIPTION OF RELATED ARTS

China Utility Patent No. 205452597U discloses a vertical type USB (Universal Serial Bus) Type C receptacle connector including an insulative housing with a mating tongue forming opposite first mating surface and second mating surface. A plurality of first contacts having corresponding first contacting sections exposed upon the first mating surface, and a plurality of second contacts having corresponding second contacting sections exposed upon the second mating surface The first contacts are full of the mating tongue while the second contacts only have a pair of power contacts spaced from each other with additional contact receiving room therebetween in the longitudinal direction, and aligned with the corresponding power contacts of the first contacts in the transverse direction perpendicular to the longitudinal direction.

Anyhow, the additional power contacts on the other mating surface are not popular used in the field. In opposite, additional signal contacts on the other mating surface are desired. Therefore, it is desired to provide a horizontal Type C connector with a full pin arrangement in one row on one mating surface and a pair of signal contacts in another row on the other mating surface wherein the soldering sections of contacts of the full pin arrangement are surface mounted in an outer position while the soldering sections of the contacts of the pair of signal contacts are surface mounted in an inner position.

SUMMARY OF THE DISCLOSURE

To achieve the above desire, a horizontal type electrical connector includes a terminal module having an insulative housing with a base and a mating tongue extending forwardly from the base wherein the mating tongue forms opposite first and second mating surfaces. The plurality of contacts are integrally formed within the housing, and including a plurality of first contacts having corresponding contacting sections exposed upon the first surface in a full manner while only a pair of second contacts having corresponding contacting sections exposed upon the second surface at a center region. The second mating surface forms a plurality of protrusions aligned with the corresponding contacting sections of the first contacts in the vertical direction so as to performing dummy contacting sections for providing a balanced force arrangement for the inserted complementary plug connector which are coupled with dual orientations.

DETAILED DESCRIPTION OF THE PREFERRED EMBODIMENT

Figure 1:
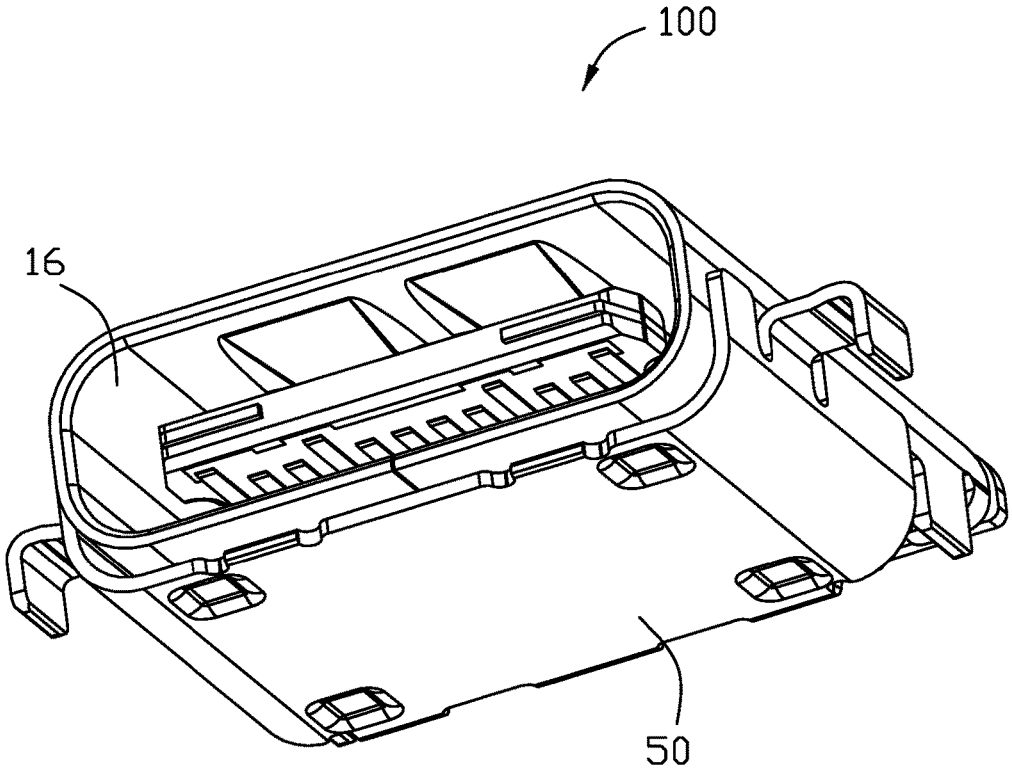
FIG. 1 is a perspective view of the electrical connector of the invention.
Figure 2:
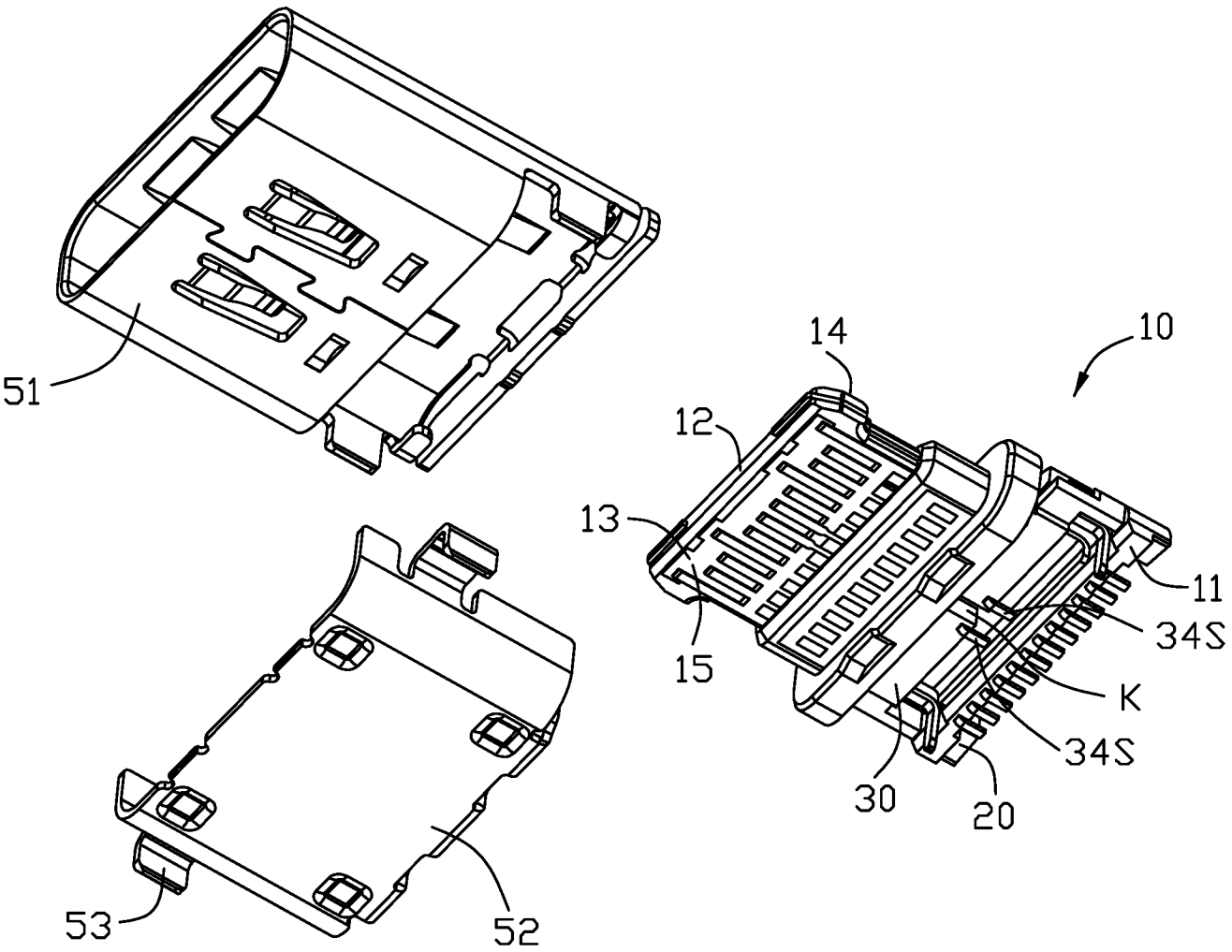
FIG. 2 is an exploded perspective view of the electrical connector of FIG. 1.
Figure 3:
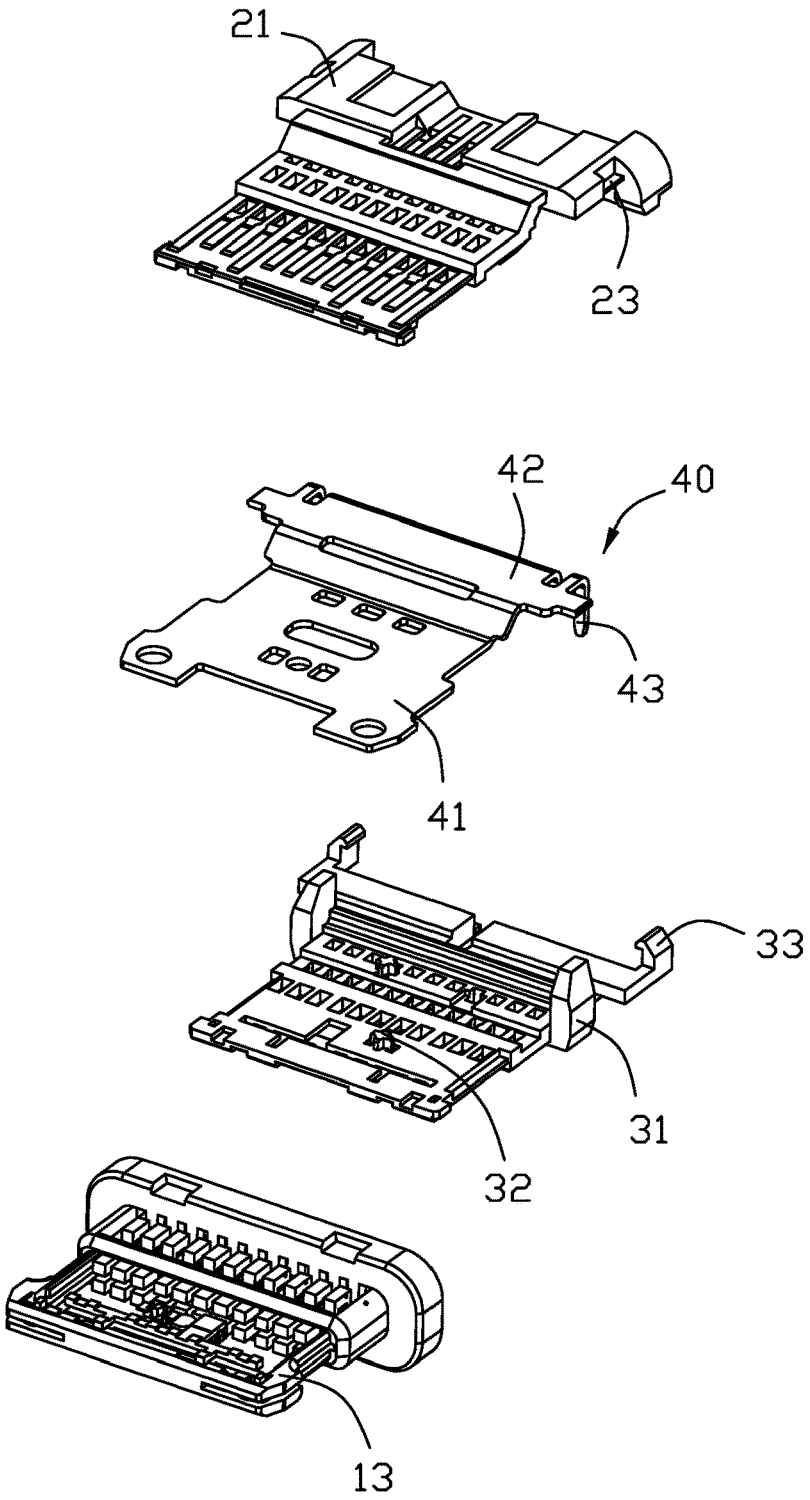
FIG. 3 is an exploded perspective view of the terminal module of the electrical connector of FIG. 1.
Figure 4:
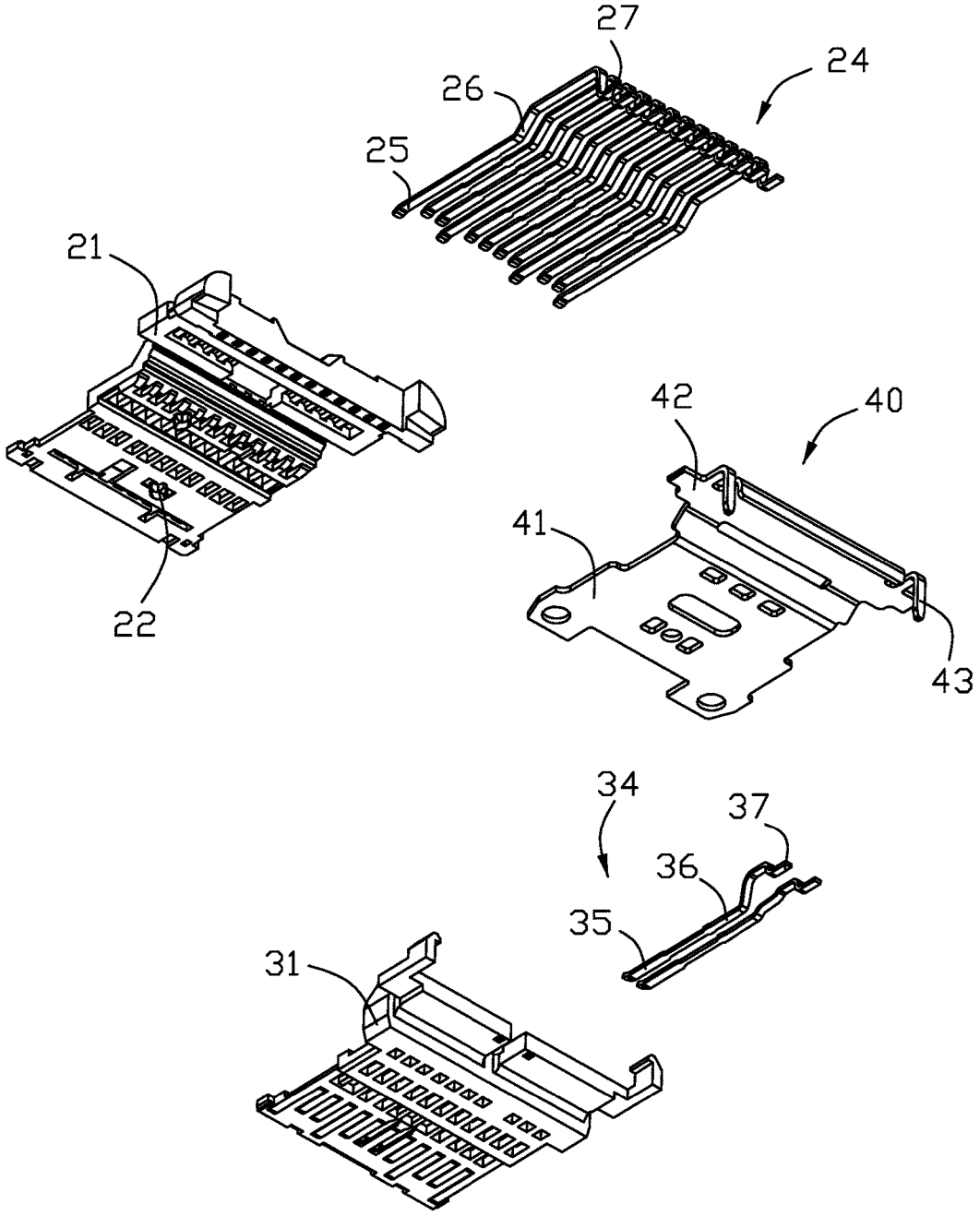
FIG. 4 is a further exploded perspective view of the terminal module of the electrical connector of FIG. 3 without the third insulator thereof.
Figure 5:
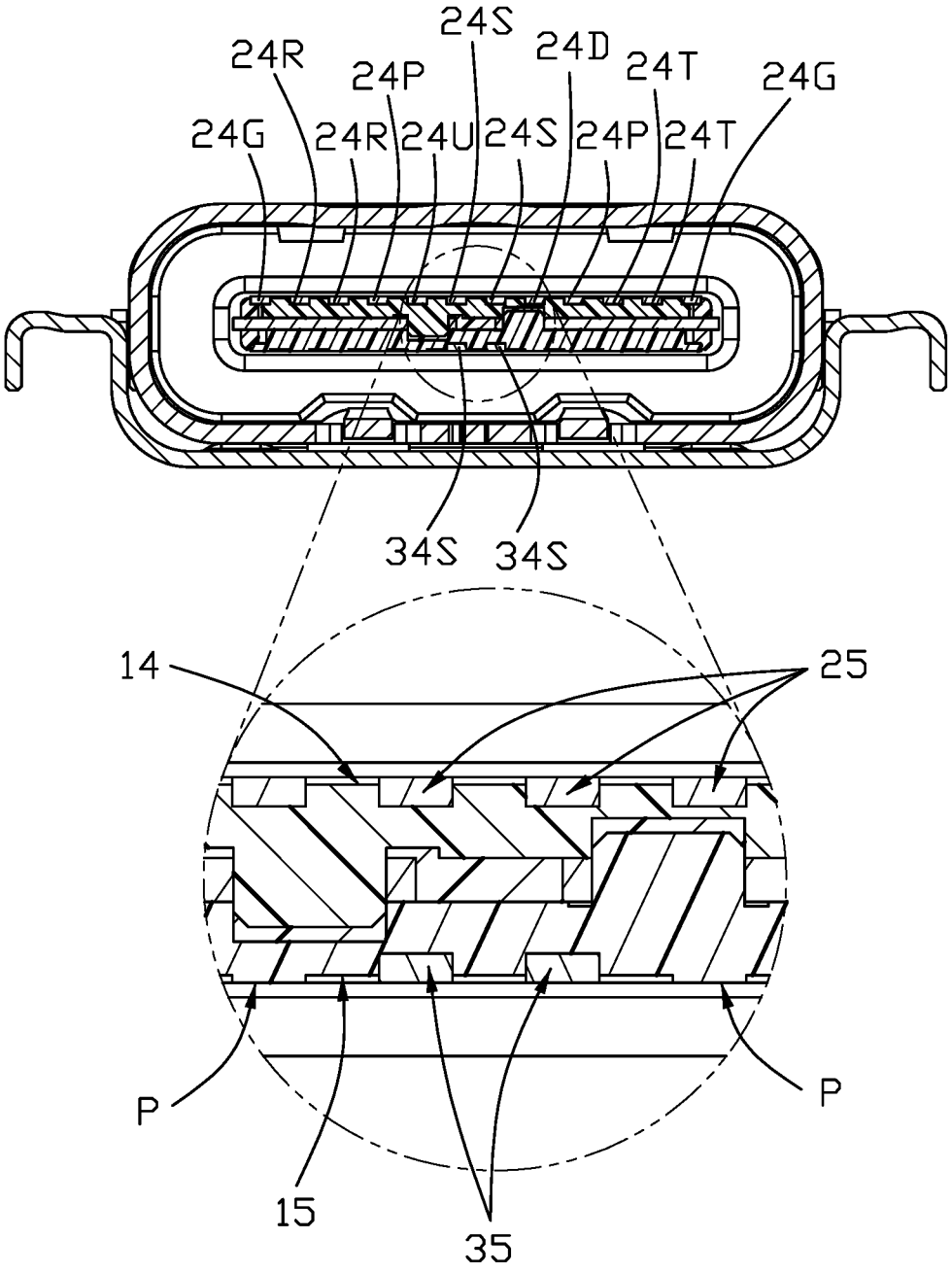
FIG. 5 is a cross-sectional view of the electrical connector of FIG. 1.

Reference will now be made in detail to the embodiments of the present disclosure. Referring to FIGS. 1-5, an electrical connector 100 includes a terminal module 10 and a metallic shielding shell 50 enclosing the terminal module 10. The shielding shell 50 includes a first/inner shell 51 and a second/outer shell 52 enclosing the first/inner shell 51. The second/outer shell 52 has the legs 53 for mounting to the printed circuit board (not shown).

The terminal module 10 includes a first contact module 20, a second contact module 30 and a metallic shielding plate 40 therebetween. The shielding plate 40 includes a first part 41, and a second part 42 extending rearwardly from the first part 41, and a pair of mounting legs 43 extending downwardly from the second part 42. The first contact module 20 includes a first insulator 21 and a plurality of first contacts 24 integrally formed within the first insulator 21 via an insert-molding process. The second contact module 30 includes a second insulator 31 and a plurality of second contacts 34 integrally formed within the second insulator 31 via another insert-molding process. The first insulator 21 forms positioning holes 22, and the second insulator forms positioning blocks 32 received in the corresponding positioning holes 22. The first insulator 21 forms a pair of steps 23, and the second insulator 31 ms a pair of latches 33 engaged upon the steps 23. A third insulator 13 is applied upon the stacked first contact module 20, the second contact 30 and the shielding plate 40 therebetween via an overmolding process to form the complete terminal module 10. Notably, the first insulator 21, the second insulator 31 and the third insulator 13 commonly form the insulative housing including the base 11 and the mating tongue 12 forwardly extending from the base 11. The mating tongue 12 forms opposite first and second mating surfaces 14, 15 in the vertical direction.

The first contacts 24 totaling twelve, include a grounding contact 24A pair of high speed differential pair signal contacts 24T, a power contact 24P, a detect contact 24D, a pair of low speed differential pair signal contacts 24S, a reversed contact 24U, another power contact 24P, another high speed differential pair signal contacts 24T and another grounding contact 24G. The second contacts totaling two, include a pair of low speed differential pair signal contacts 34S.

Each of the first/second contacts 24/34 has a contacting section 25/35 exposed upon the corresponding first/second mating surfaces 14/15, the corresponding first/second retaining section 26/36 in the base 11, and the corresponding first/second soldering section 27/37 exposed outside of the housing.

One feature of the inventions is to have the second contacts 34 only with the pair of low speed differential pair signal contacts 34S wherein the contacting sections 35 of the two second contacts 34, i.e., the low speed differential pair signal contacts are aligned with the contacting sections 25 of the first contact 24 in the vertical direction while the soldering sections 37 of the two second contacts 34, i.e. the low speed differential pair signal contacts 34, are outwardly offset from each other with a space K formed in the second contact module 30 in the transverse direction so as not to aligned with the soldering sections 27 of the corresponding low speed differential pair signal contacts 24S in a front-to-back direction.

Another feature of the invention is to provide the a plurality of protrusions P slightly protruding beyond the corresponding second mating surface 15. It is because the contacting sections 25 of said first contacts 24 slightly project beyond the corresponding first mating surface 14, and the contacting sections 35 of the second contacts 34 slightly project beyond the second mating surface 15. The protrusions P, which essentially are deemed and dimensioned as dummy contacting sections in place of the missing ones, may counterbalance the forces derived from deflection of the spring contacts of the complementary plug connector (not shown) applied upon all the first contacts 24 and the pair of second contacts 34. Understandably, without such protrusions P, the mated complementary plug connector may not be stale during mating due to lacking the counterbalanced forces applied thereto. Notably, because those protrusions P are essentially the replacement of the contacting sections of the missing/removed second contacts 34, the protrusions P should be aligned with the contacting sections 25 of the corresponding first contacts 24 in the vertical direction.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a terminal module enclosed within a metallic shielding shell, and including a first contact module having a first insulator and a plurality of first contacts integrally formed within the first insulator via an insert-molding process, a second contact module having a second insulator and a plurality of second contacts integrally formed with the second insulator via another insert-molding process, and a shielding plate sandwiched between the first contact module and the second contact module in a vertical direction, the terminal module further defining opposite first and second mating surfaces in the vertical direction, each of the first contacts and the second contacts including a contacting section, an amount of the first contacts being more than that of the second contacts; wherein the contacting sections of the first contacts are exposed upon the first mating surface and slightly project beyond the first mating surface, and the contacting sections of the second contacts are exposed upon the second mating surface and slightly project beyond the second mating surface; wherein the second insulator further forms a plurality of protrusions slightly projecting beyond the second mating surface and coplanar with the contacting sections of the second contacts in a transverse direction perpendicular to the vertical direction; wherein said protrusions are aligned with the contacting sections of the corresponding first contacts, respectively, in the vertical direction.

2. The electrical connector as claimed in claim 1, wherein the second contacts have only a pair of low speed differential pair signal contacts adjacent to each other around a center region of the terminal module in the transverse direction.

3. The electrical connector as claimed in claim 2, wherein the contacting sections of the pair of low speed differential pair signal contacts of the second contacts are aligned with the contacting section of another pair of low speed differential pair signal contacts of the first contacts in the vertical direction.

4. The electrical connector as claimed in claim 3, wherein each of said first contacts and said second contacts further includes a soldering section exposed outside of the corresponding insulator, and the soldering sections of the low speed differential pair signal contacts of the second contacts are outwardly offset from each other so as not to be aligned with the soldering sections of the low speed differential pair signal contacts of the first contacts in a front-to-back direction perpendicular to both the vertical direction and the transverses direction.

5. The electrical connector as claimed in claim 4, further including a third insulator to be commonly integrally formed with the first contact module, the second contact module and the shielding plate.

6. The electrical connector as claimed in claim 5, wherein said low speed differential pair signal contacts of the second contacts are adjacent to each other around a central region of the terminal module in the transverse direction.

7. An electrical connector comprising:

a terminal module enclosed within a metallic shielding shell, said terminal module including an insulative housing and a plurality of contacts embedded within the housing via insert-molding, the housing forming a first mating surface and a second mating surface opposite to each other in a vertical direction, each of the contacts having a front contacting section and a rear soldering section along a front-to-back direction perpendicular to said vertical direction, the contacting sections of the contacts being exposed upon the first mating surface and slightly projecting beyond the first mating surface in the vertical direction, wherein the second mating surface forms a plurality of protrusions thereon in alignment with the contacting sections of the contacts in the vertical direction, respectively.

8. The electrical connector as claimed in claim 7, further including a plurality of other contacts embedded within the housing, wherein each of said other contacts forms a contacting section exposed upon and slightly projects beyond the second mating surface in the vertical direction, and wherein the contacting sections of said other contacts are coplanar with the protrusions in a transverse direction perpendicular to both said vertical direction and said front-to-back direction.

9. The electrical connector as claimed in claim 8, wherein said contacting sections of said other contacts are aligned with the contacting sections of the corresponding contacts in the vertical direction while soldering sections of said other contacts are outwardly offset from each other in the transverse direction so as not to be aligned with the soldering sections of the corresponding contacts in the front-to-back direction.

10. The electrical connector as claimed in claim 9, wherein said other contacts are only a low speed differential pair signal contacts adjacent to each other around a central region in the transverse direction.

11. An electrical connector comprising:

a terminal module enclosed within a metallic shielding shell, said terminal module including an insulative housing and a plurality of first contacts and a plurality of second contacts embedded within the housing via insert-molding, the housing forming a first mating surface and a second mating surface opposite to each other in a vertical direction, each of the first contacts and the second contacts having a front contacting section and a rear soldering section along a front-to-back direction perpendicular to said vertical direction, the contacting sections of the first contacts being exposed upon the first mating surface and slightly projecting beyond the first mating surface in the vertical direction, and the contacting sections of the second contacts being exposed upon the second mating surface and slightly projecting beyond the second mating surface, wherein there are only low speed differential pair signal contacts of the second contacts; wherein said contacting sections of said second contacts are aligned with the contacting sections of the corresponding first contacts in the vertical direction while the soldering sections of said second contacts are outwardly offset from each other in a transverse direction perpendicular to both the vertical direction and the front-to-back direction so as not to be aligned with the soldering sections of the corresponding first contacts in the front-to-back direction.

12. The electrical connector as claimed in claim 11, wherein the contacting sections of the second contacts are located around a central region of the terminal module in the transverse direction.

* * * * *